US005450172A

United States Patent [19]

Suzuki et al.

[11] Patent Number: 5,450,172

[45] Date of Patent: Sep. 12, 1995

[54] NONDESTRUCTIVE MULTICOLOR IMAGE FORMING APPARATUS

[75] Inventors: Koji Suzuki, Yokohama; Naoki Iwata, Tokyo; Akira Sawada, Yokohama; Kazuhiro Nishido, Tokyo, all of Japan

[73] Assignee: Ricoh Company, Ltd., Tokyo, Japan

[21] Appl. No.: 239,135

[22] Filed: May 6, 1994

[30] Foreign Application Priority Data

May 6, 1993 [JP] Japan ..... 5-129928

[51] Int. Cl.[6] ..... G03G 15/01

[52] U.S. Cl. ..... 355/326 R; 355/246

[58] Field of Search ..... 355/208, 245, 246, 259, 355/326 R, 327; 118/645, 653

[56] References Cited

U.S. PATENT DOCUMENTS

| | | | |
|---|---|---|---|
| 4,809,038 | 2/1989 | Yamamoto et al. | 118/645 X |
| 5,030,996 | 7/1991 | Tajima et al. | 355/246 |
| 5,066,979 | 11/1991 | Goto et al. | 355/245 X |
| 5,187,535 | 2/1993 | Tajima | 355/326 R |
| 5,241,357 | 8/1993 | Iwata | 355/326 R |
| 5,307,127 | 4/1994 | Kobayashi et al. | 355/259 |

*Primary Examiner*—William J. Royer

*Attorney, Agent, or Firm*—Oblon, Spivak, McClelland, Maier & Neustadt

[57] ABSTRACT

A color copier capable of producing, without disturbing a toner image formed in the first color, an image in the second color and preventing the first color from being mixed with the second color. In the event of development in the second color, a bias voltage is applied to a developing roller at a repetition frequency shorter than 5 kHz. One period of the bias voltage consists of a pulse voltage VPULS having a duration TA (shorter than 100 μsec), and a DC bias voltage VDC having a duration TB. The pulse voltage VPULS is higher than the potential VD of a non-image area in order to enhance a developing potential. The DC voltage VDC is lower than the potential VD and a potential VT of a toner layer of first color and higher than the potential VL of an image area in order to set up a sufficient developing potential. The DC voltage VDC and the potential VT has a potential difference smaller than 500 V. A gap for development ranges from 100 μm to 300 μm. The pulse voltage VPULS may include an overshoot portion at the negative-going edge thereof or may be replaced with a voltage having a triangular waveform. The adhesion of the toner of first color to an image carrier is not susceptible to electric fields formed for development in the second color. For development in the second color, a toner exhibiting a particular moving characteristic in the gap is used.

19 Claims, 12 Drawing Sheets

NONDESTRUCTIVE MULTICOLOR IMAGE FORMING APPARATUS

BACKGROUND OF THE INVENTION

The present invention relates to a copier, facsimile apparatus, printer or similar image forming apparatus and, more particularly, to a multicolor image forming apparatus of the type forming a multicolor toner image on an image carrier and then transferring it to a recording medium at a time.

With a multicolor image forming apparatus, it is possible to form a multicolor toner image on an image carrier by use of developers of different colors. A nonmagnetic toner, or one component type developer, is advantageously used with developing means for the second color since it reduces the size and cost of the apparatus and is easy to color. It has been customary to cause this kind of toner to deposit on a developer carrier in a layer and face, but not contact, an image carrier, thereby effecting development. This development does not disturb a toner image of a first color existing on the image carrier.

The image forming apparatus has, for example, a plurality of developing means arranged around an image carrier. In this kind of apparatus, developing means assigned to the first color stores a chromatic toner, which constitutes a two component type developer in combination with a carrier. Developing means assigned to the second color and located downstream of the above-mentioned developing means stores a black toner, or one component type developer. The black toner is charged to a polarity opposite to the polarity of the chromatic toner. In the downstream developing means, the toner is deposited on a developer carrier in a thickness of 30 μm to 500 μm. In the event of development, an AC bias voltage is applied to the developer carrier of the downstream or second developing means for generating an AC electric field which effects development by the toner. While development is not effected, a bias voltage which causes the chromatic toner of the upstream or first developing means to develop an image is applied to the developer carrier of the second developing means. This kind of scheme is taught in, for example, Japanese Patent Laid-Open Publication No. 63-60471.

However, the apparatus described above has a problem that at the time of development in the second color, the toner of second color moves back and forth between the latent image surface of the image carrier and the surface of the developer carrier while hitting against the latent image surface due to the AC bias. Such a toner is apt to disturb a toner image formed on the image carrier in the first color. Moreover, the toner of first color is apt to move back and forth together with the toner of second color while hitting against the surface of the developer carrier, entering the developing means assigned to the second color. As a result, the toner of second color stored in the developing means becomes turbid.

In light of this, there has been proposed a multicolor image forming apparatus which applies a DC bias voltage for development in the second color. The DC bias causes a nonmagnetic toner to fly toward the image carrier, thereby obviating color mixture. For example, a plurality of developing means are arranged around an image carrier having a 35 μm to 90 μm thick photoconductive layer which has a capacitance of 20 pF/cm$^2$ to 170 pF/cm$^2$ and is made of selenium or arsenic selenide. Charging, exposing and developing steps are repeated a plurality of times to form a composite color image on the same image carrier. In the developing means assigned to the second color, a gap less than 250 μm is formed between a developer carrier and the image carrier. A DC bias voltage is applied to the developer carrier to execute non-contact development by using a thin toner layer. At this instant, the other developer carriers not contributing to the development are held inoperative, i.e., toners are deposited thereon at the outside of their imaging regions. For this type of apparatus, a reference may be made to Japanese Patent Laid-Open Publication No. 63-63061. This document includes an embodiment using an image carrier implemented by an organic photoconductor having a 15 μm to 50 μm thick photoconductive layer, charging means in the form of a scorotron charger, reversal development, a potential contrast greater than 400 V, and a 5 μm to 30 μm thick toner layer deposited on the photoconductor.

Another type of multicolor apparatus image forming apparatus includes a plurality developing means facing, but not contacting, a recording medium. In this type of apparatus, first or upstream developing means includes a developer carrier to which a DC-biased AC bias is applied for black development. The developer carrier is rotated in the same direction as, but at a higher peripheral speed than, the recording medium. Second and successive developing means each includes a developer carrier to which only a DC bias is applied for color development. Such an apparatus is disclosed in, for example, Japanese Patent Laid-Open Publication No. 63-85578. This apparatus, however, has a drawback that when the toner is caused to fly under the electric field generated by the DC bias, cohered toner particles locally come off in low contrast portions, resulting in a granular image. Another drawback is that in latent line images, the edge electric fields of the latent images run around to the image carrier side, preventing thin lines from being reproduced.

SUMMARY OF THE INVENTION

It is, therefore, an object of the present invention to provide a multicolor image forming apparatus capable of forming images of second and successive colors without disturbing an image of first color existing on an image carrier, and eliminating color mixture in second and successive developing means.

In accordance with the present invention, in a multicolor image forming apparatus for forming a visible multicolor image on an image carrier and then transferring the multicolor image to a transfer medium at a time, developing units respectively assigned to a second and successive colors each comprises a developer carrier for carrying a one component type developer on the surface thereof, and a bias voltage source for applying to the developer carrier a periodically changing bias voltage having one period consisting of a first period of time and a second period of time. The bias voltage source applies for the first period of time a first voltage which generates in a gap between the image carrier and the developer carrier an electric field for causing the developer to fly toward an image area and a non-image area of the image carrier. For the second period of time, the bias voltage source applies a second voltage which generates in the gap an electric field for returning the developer flying toward the non-image portion toward the developer carrier and for preventing the developer existing on the image carrier from leaving it. The first period of time is selected such that the developer does not reach the non-image area while the developer existing on the image carrier does not fly toward and reach the developer carrier.

Also, in accordance with the present invention, in a multicolor image forming apparatus for forming a visible multicolor image on an image carrier and then transferring the multicolor image to a transfer medium at a time, developing units respectively assigned to a second and successive colors each comprises a developer carrier for carrying a one component type developer on the surface thereof, and a bias voltage source for applying to the developer carrier a periodically changing bias voltage having one period consisting of a first period of time and a second period of time. The bias voltage source applies for the first period of time a first voltage which generates in a gap between the image carrier and the developer carrier an electric field for causing the developer to fly toward an image area and a non-image area of the image carrier. For the second period of time, the bias voltage source applies a second voltage which generates in said gap an electric field for causing the developer to fly toward the image portion, and returning the developer having flown toward the non-image area during the first period of time toward the developer carrier. The first period of time is selected such that the developer does not reach the non-image area. For development in the second and successive colors, the adhesion of the developer existing on the image carrier to the image carrier is not susceptible to the electric field generated in the gap by the bias voltage.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 2:
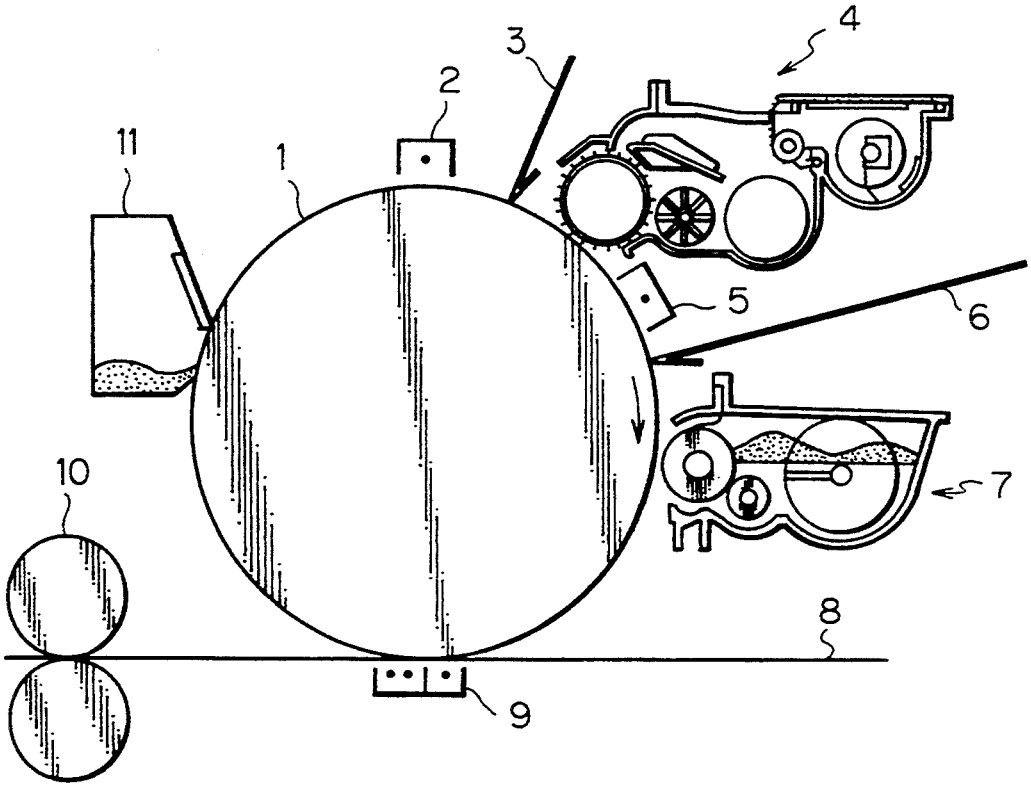
FIG. 2 is a schematic front view of the embodiment.

Referring to FIG. 2 of the drawings, a multicolor image forming apparatus embodying the present invention is shown and implemented as an electrophotographic color copier. As shown, the copier has a photoconductive drum, or image carrier, 1 provided with a photoconductor 1*a*, FIG. 4, thereon. The copier forms a bicolor toner image on the drum 1 and then transfers it to a paper or similar recording medium 8 at a time. Developing units, or developing means, 4 and 7 store developers containing toners of first and second colors, respectively. The toners are chargeable to the same polarity as the photoconductor 1*a* of the drum 1. Both the developing units 4 and 7 effect negative-to-positive development. Arranged around the drum 1 are, in addition to the developing units 4 and 7, an exposing device, not shown, a first charger 2, a second charger 5, an image transfer unit 9, a cleaning unit 11, etc.

Figure 3A:
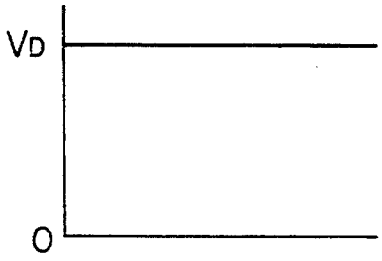
FIGS. 3A–3F each shows a potential deposited on a photoconductive element included in the embodiment after a particular image forming step.
Figure 3B:
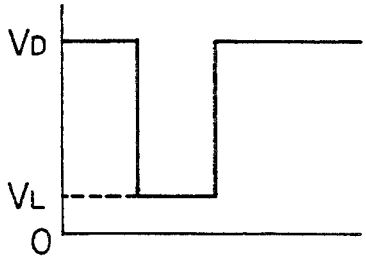
Figure 3C:
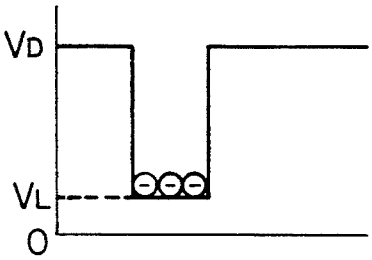
Figure 3D:
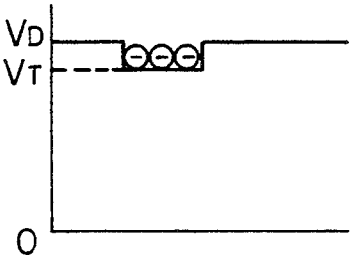
Figure 3E:
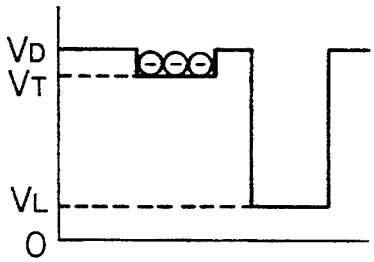
Figure 3F:
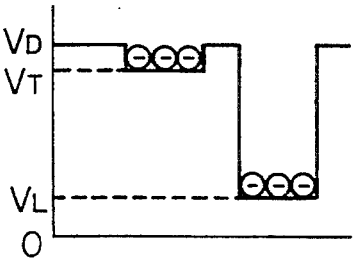

The operation of the copier will be outlined with reference to FIG. 3A–F. To begin with, the first charger 2 uniformly charges the photoconductor 1*a* to a potential VD, as shown in FIG. 3A. As the exposing device exposes the charged photoconductor to a light image 3 representative of a first color image, a first latent image is electrostatically formed on the photoconductor 1*a*, as shown in FIG. 3B. At this instant, a potential VL is deposited on the light portion of the first latent image. The first developing unit 4 develops the first latent image, i.e., deposits the toner of first color on the photoconductor 1*a* to form a toner image of first color, as shown in FIG. 3C. Then, the second charger 5 charges the photoconductor 1*a* from above the toner image of first color with the result that the portion exposed to the light image 3 is provided with substantially the same potential as the surrounding portion, as shown in FIG. 3D. At this instant, the surface potential of the toner image of first color is VT which is slightly lower than the potential VD. Next, the exposing device exposes the photoconductor 1*a* to a light image 6 representative of a second color image, thereby forming a second latent image, as shown in FIG. 3E. The second developing unit 7 develops the second latent image, as shown in FIG. 3F. As a result, a toner image of second color is formed on the photoconductor 1*a* together with the toner image of first color.

The bicolor toner image formed by the above procedure is collectively transferred by the transfer unit 9 to a paper 8 being moved along a transport path. The fixing unit 10 fixes the bicolor image on the paper 8, thereby completing a multicolor image. After the image transfer, toner particles remaining on the photoconductor 1*a* are removed by the cleaning unit 11, so that the photoconductor 1*a* is prepared for another image forming cycle.

Figure 4:
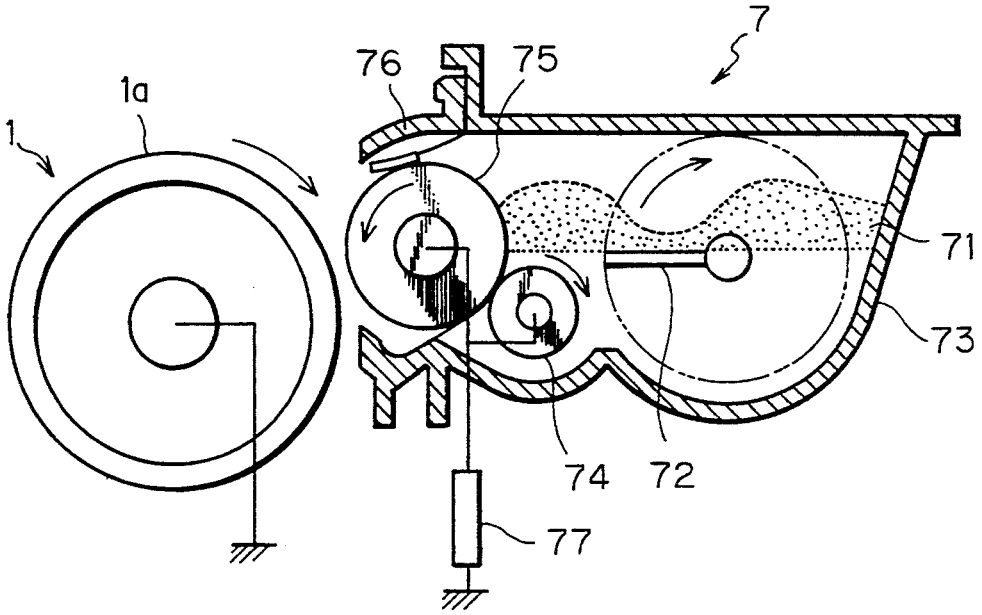
FIG. 4 is a front view of a developing unit included in the embodiment.

As shown in FIG. 4, the developing unit 7 for the second color stores a toner, i.e., nonmagnetic one component type developer 71. The unit 7 includes a hopper 73 having an agitator 72, a toner supply member 74, a developing roller, or developer carrier, 75, a toner regulating member 76, and a bias power source, or bias voltage applying means, 77. The toner of second color 71 is replenished into the hopper 71 and agitated by the agitator 72. The toner 71 handed over from the hopper 73 to the toner supply member 74 is frictionally charged by the member 74 and the developing roller 75 and, as a result, deposited on the roller 75. The toner is conveyed by the developing roller 75 to a developing region where the roller 75 faces the photoconductor 1*a*, while being regulated into a uniform layer by the regulating member 76. The roller 75 and the photoconductor 1*a* face, but not contact, each other and their surfaces move at substantially the same speed in directions indicated by arrows in the figure. The gap between the roller 75 and the photoconductor 1*a* should preferably range from 0.1 mm to 0.3 min. In the event of development, a predetermined bias voltage VB is applied from the bias power source 77 to the roller 75 and supply member 74.

Figure 5A:
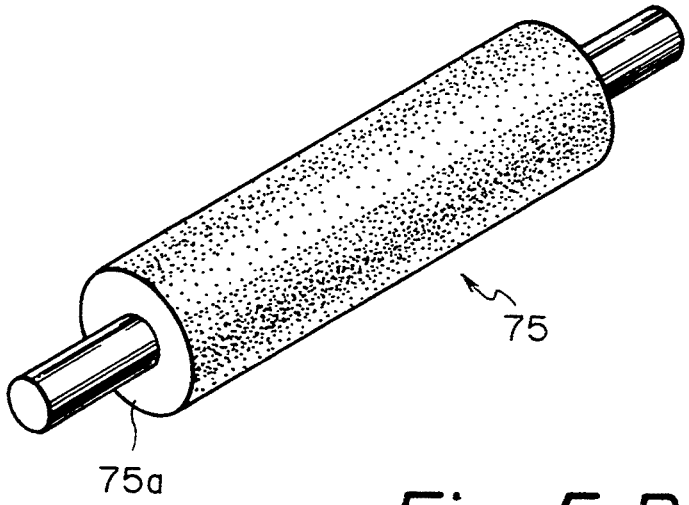
FIGS. 5A and 5B are respectively a perspective view and a section showing a developing roller included in the developing unit.
Figure 5B:
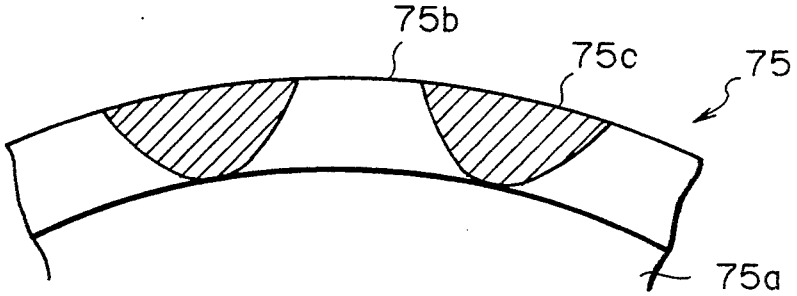

FIG. 5A shows a specific configuration of the developing roller 75 applicable to the embodiment. FIG. 5B is a section in a plane including the axis of the roller 75. As shown in FIG. 5B, The roller 75 has a shaft or core 75*a*, and a surface layer formed on the core 75*a*. The surface layer is implemented by a conductive resin 75*b*, and dielectric particles 75*c* buried in the resin 75*b* and appearing on the surface of the roller 75. Frictional charges are deposited on the dielectric particles 75*c* to form numerous small closed electric fields, or microfields, on the roller 75. The nonmagnetic toner 71 is brought to the developing region by being retained by such microfields.

Figure 6A:
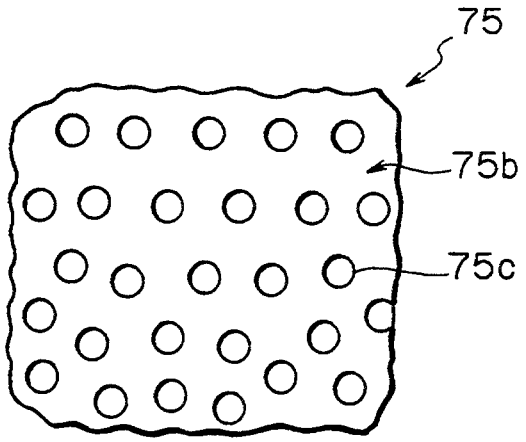
FIG. 6A is a plan view of a modified form of the developing roller.
Figure 6B:
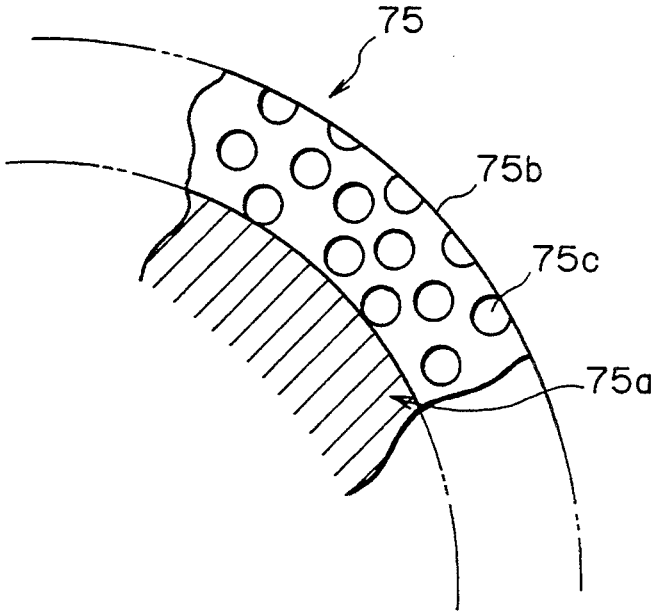
FIG. 6B is a section of a surface layer provided on the roller of FIG. 6A.
Figure 6C:
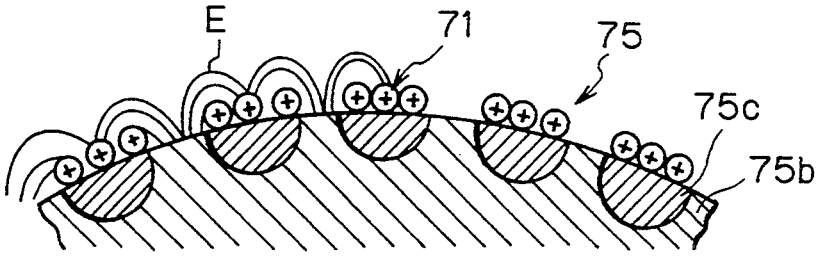
FIG. 6C shows microfields generated on the roller of FIG. 6A.

As shown in FIGS. 6A–6C, the developing roller 75 may alternatively be implemented by a metallic core 75*a*, and a surface layer consisting of a conductive resin 75*b* and dielectric particles 75*c* dispersed in the resin 75*b*. By frictionally charging the dielectric particles 75*c*, it is possible to form sufficient microfields E, as shown in FIG. 6C. The microfields retain the nonmagnetic toner 71 being conveyed toward the developing region. At this instant, the amount of toner deposition on the roller 75 is, for example, about 1.5 mg/cm$^2$ while the toner is charged in an amount of about 10 $\mu$C/g.

Figure 7A:
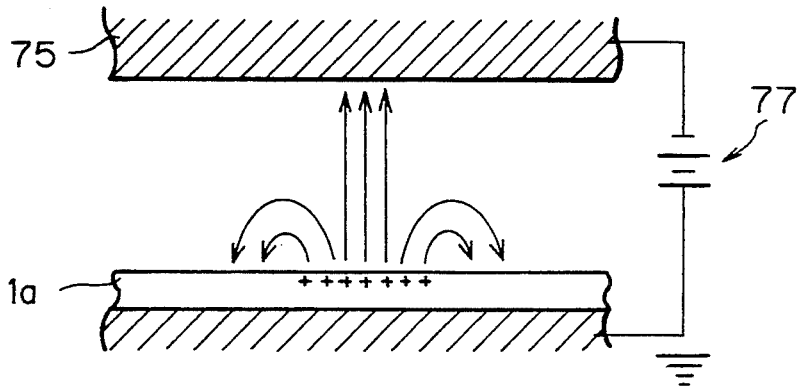
FIG. 7A shows an electric field distribution occurring in a gap for development in the embodiment.
Figure 7B:
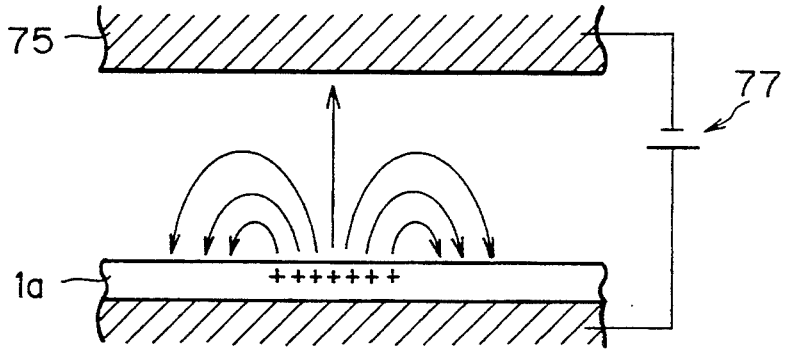
FIG. 7B shows an electric field distribution particular to a conventional copier.

Assume that after the toner image of first color has been formed on the photoconductor 1*a*, an AC voltage is applied to the developing roller 75 as the bias VB in the event of development in the second color. Then, it is likely that the toner of second color flies back and forth between the photoconductor 1*a* and the drum 75 while hitting against the photoconductor 1*a*, disturbing the toner image of first color. It is also likely that the toner of first color flies back and forth together with the toner of second color 71 while hitting against the roller 75; should the toner of first color be introduced into the developing unit of second color 7, the toner of second color 71 would become impure. To obviate these occurrences, a DC voltage may be applied to the roller 75 as the bias VB. A DC voltage, however, is apt to cause the toner cohered at low contrast portions to locally come off, resulting in a critically granular image. Moreover, as shown in FIG. 7B, a DC voltage is likely to cause the edge fields of a latent image to run around to the photoconductor 1*a* side, preventing thin lines from being reproduced.

Figure 1:
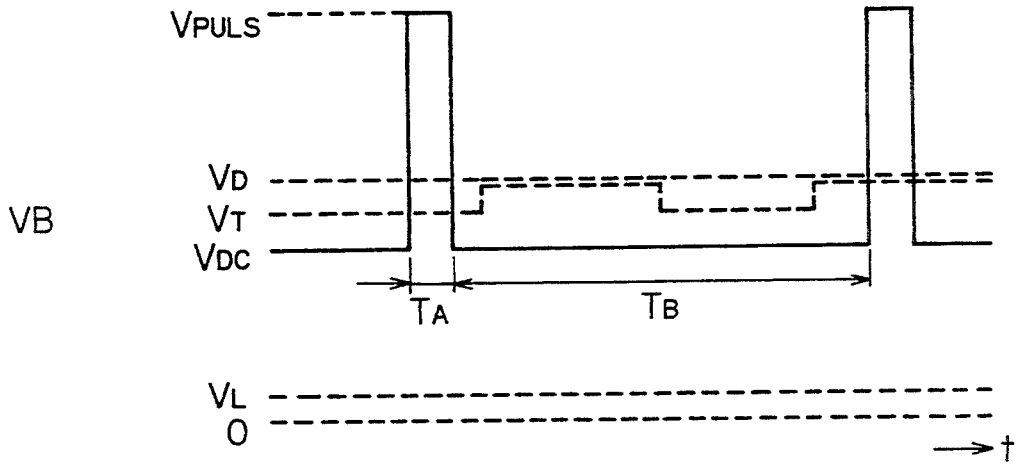
FIG. 1 shows a specific waveform of a bias voltage for development particular to an image forming apparatus embodying the present invention.

To eliminate the above problems, the embodiment applies a bias voltage VB, FIG. 1, when the developing unit of second color 7 performs development with the toner 71. Specifically, as shown in FIG. 1, a pulse voltage, or first voltage, VPULS is applied to the developing roller 75 for a period of time, or first duration, TA of a single period. Then, a DC voltage, or second voltage, VDC is applied to the roller 75 for a period of time, or second duration, TB. Thus, the bias voltage VB changes in voltage periodically. In FIG. 1, the abscissa indicates time (t).

The pulse voltage VPULS is greater in absolute value than the potential VD deposited on the non-image area of the photoconductor 1*a*, thereby increasing a developing potential. On the other hand, the DC voltage VDC is smaller in absolute value than the potential VT of the toner layer of first color and the potential VD, but it is greater in absolute value than the potential VL of the light portion of the image. This is successful in ensuring a sufficient developing potential.

The bias voltage VB is applied in the event of development in the second color. Then, when the pulse voltage VPULS is applied, the toner 71 on the developing roller 75 starts flying toward the surface of the photoconductor 1*a* without regard to the image/non-image area of the photoconductor 1*a*. At this time, electric fields are distributed in the gap for development, as shown in FIG. 7A. As shown, intense electric fields are formed to prevent the thickness of latent line images formed on the photoconductor 1*a* from being degraded. In addition, since the toner 71 floated above the roller 75 flies along such electric fields faithfully, even thin lines are accurately reproduced.

Figure 8:
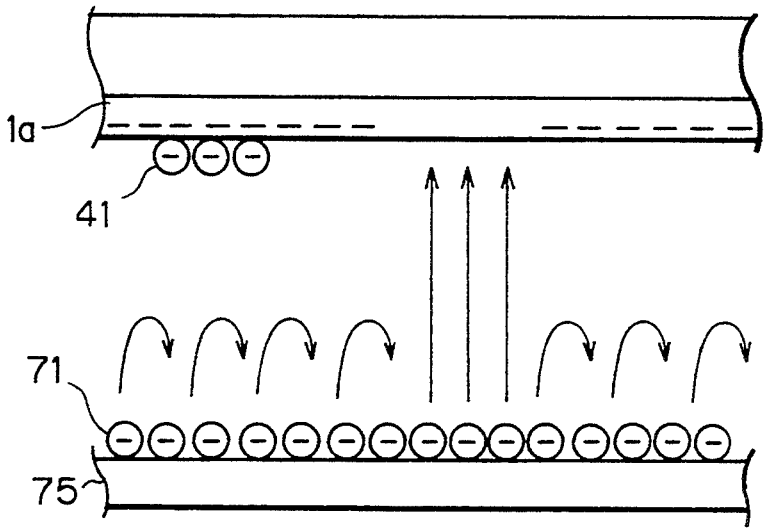
FIG. 8 shows how a toner flies in the gap in the embodiment when a DC bias forming a part of a bias voltage is applied.

As shown in FIG. 8, when the DC voltage VDC is applied to the roller 75, the toner flying toward the non-image area of the photoconductor 1*a* does not reach it, but it is simply returned to the roller 75. On the other hand, the toner flying toward the image area of the photoconductor 1*a* surely reaches it and forms a toner image. In FIG. 8, the toner 71 forms a toner layer of second color on the roller 75 while the toner 41 is the toner of first color already deposited on the photoconductor 1*a*.

Another advantage particular to the bias voltage VB is that the toner 71 is loosened on the developing roller 75 by being caused to oscillate. As a result, even a low contrast portion can be reproduced with smoothness.

Further, in the event of development in the second color, the toner 71 is prevented from flying back and forth in the gap for development, while hitting against the surface of the photoconductor 1a. This protects the toner image of first color existing on the photoconductor 1a and, in addition, substantially eliminates an occurrence that the toner of first color 41 comes off the photoconductor 1a and flies into the developing unit for the second color 71, making the toner of second color turbid.

Figure 9:
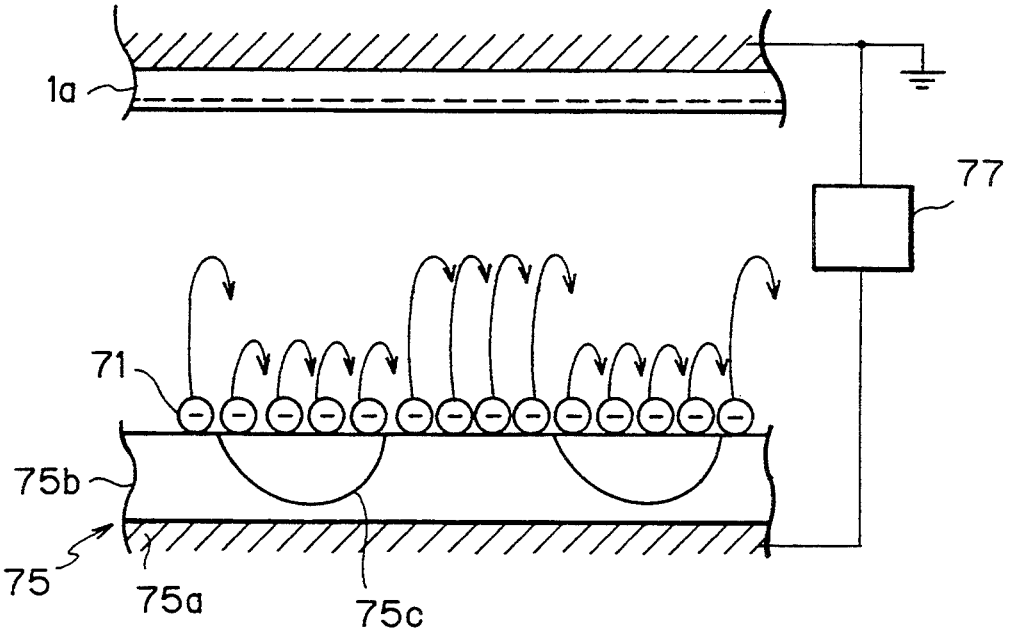
FIG. 9 shows how a toner on a conductive portion and dielectric portions constituting the developing roller flies in the gap.

Assume the developing roller 75 having the conductive portion 75b and fine dielectric portions 75c dispersed in the conductive portions 75b, as shown in FIGS. 5A and 5B or FIGS. 6A–6C. When the bias voltage VB, i.e., the DC voltage VDC on which the pulse voltage VPULS is superposed is applied to such a roller 75, intense electric fields are formed in the conductive portion 75b at the peak of the pulse voltage VPULS, as shown in FIG. 9. As a result, in the conductive portion 75b, the toner moves more than in the dielectric portions 75c. It follows that the toner deposited in the conductive portion 75b is easy to fly even toward the low contrast portions of the image, while the toner deposited on the dielectric portions flies only to the high contrast portions of the image. This is successful in providing the image with desirable tonality.

How the toner 71 flies toward the photoconductor 1a when the bias voltage VB is applied to the developing roller 75 will be described more specifically. The movement of the toner 71 through the gap between the roller 75 and the photoconductor 1a may be analytically calculated by the equation of motion:

$$m\frac{d^2x}{dt^2} = qE - 6\pi\mu\gamma\frac{dx}{dt} \qquad \text{Eq. (1)}$$

where m is the mass of the toner, x is the distance which the toner flies, t is time, q is the amount of charge on the toner, E is the electric field for development, $\mu$ is the coefficient of viscosity of air, and $\gamma$ is the radius of toner particles.

Figure 10:
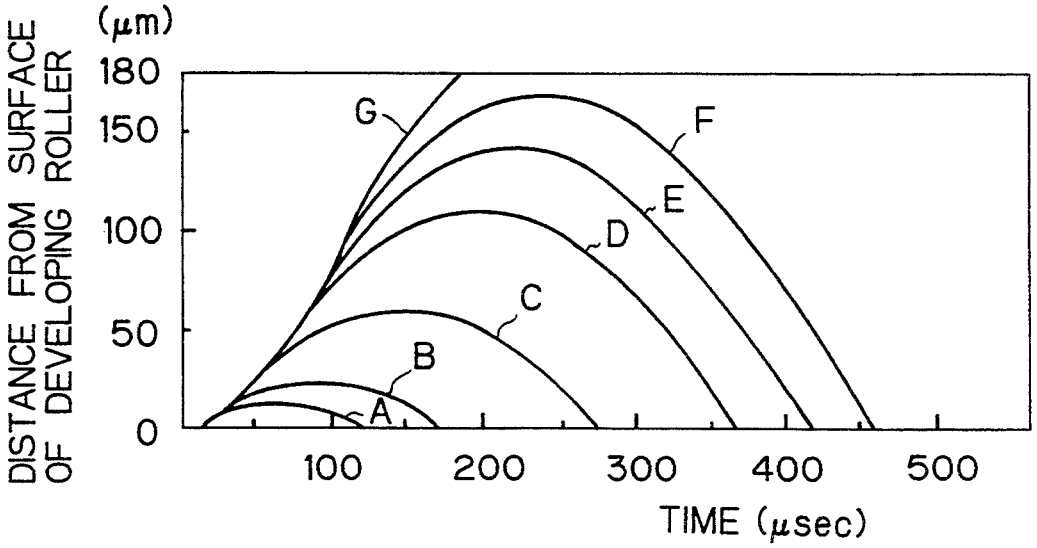
FIG. 10 is a graph representative of a distance which a toner flies in the gap and which changes with a change in the duration of a pulse voltage, which forms the other part of the bias voltage, as determined by calculation.

When the duration of the pulse voltage included in the bias voltage is changed, the distance which the toner flies toward the non-image area of the photoconductor 1a changes, as shown in FIG. 10. The distances of FIG. 10 are calculated by use of the Eq. (1). In FIG. 10, the abscissa and the ordinate respectively indicate the time elapsed and the distance as measured from the surface of the developing roller 75. For the calculation, toner particles were assumed to be spherical particles having a volumetric mean particle size of 10 μm and a true density of 1 g/cm$^3$. The amount of charge per particle was 10 μC while the gap for development was 180 μm. The pulse voltage VPULS and the DC voltage VDC were selected to be 1200 V and 700 V, respectively. The potential VD to deposit on the non-image area of the photoconductor 1a was 850 V. In FIG. 10, curves A, B, C, D, E, F and G are respectively associated with the durations of pulse voltage VPULS of 20 μs, 30 μsec, 50 μsec, 70 μs, 80 μsec, 90 μsec, and 100 μsec.

As FIG. 10 indicates, the toner is difficult to fly when the pulse duration TA is shorter than 30 μsec, but it reaches the non-image area of the photoconductor 1a when the duration TA exceeds 100 μsec. Experiments conducted under the above conditions showed that when the duration TA is longer than 100 μsec, the amount of toner to deposit on the non-image area, or background, of the photoconductor 1a increases. This accurately coincides with the results of calculation. The pulse duration TA, therefore, should preferably be shorter than 100 μsec.

When the duration TB of the DC voltage VDC is shorter than 200 μsec, electric fields causing the toner 71, once floated away from the surface of the roller 75 and tending to return, to again fly toward the photoconductor 1a are formed. As a result, the toner 71 forms clouds in the gap for development, aggravating the sharpness of the image. Therefore, the duration of the DC voltage VDC should preferably be longer than 200 μsec.

Further, when the repetition frequency of the bias voltage VB is higher than 5 kHz, i.e., when the duration of one period is shorter than 200 μsec, electric fields causing the toner 71, once floated away from the surface of the roller 75 and tending to return, to again fly toward the photoconductor 1a are formed. This also results in the above-mentioned undesirable occurrence. Hence, the repetition frequency should preferably be less than 5 kHz.

When the gap for development is smaller than 100 μm, most of the toner of second color 71 reaches the non-image area of the photoconductor 1a, aggravating the contamination of the background. On the other hand, when the gap is greater than 300 μm, it is difficult to form the electric fields for development, resulting in an unclear image. It is, therefore, preferable that the gap lies in the range of from 100 μm to 300 μm.

When the difference between the DC voltage VDC and the potential of the toner layer of first color 41 on the photoconductor 1a is greater than 500 V, the toner 41 leaves the photoconductor 1a and returns to the roller 75. Therefore, the difference should preferably be less than 500 V.

Figure 11:
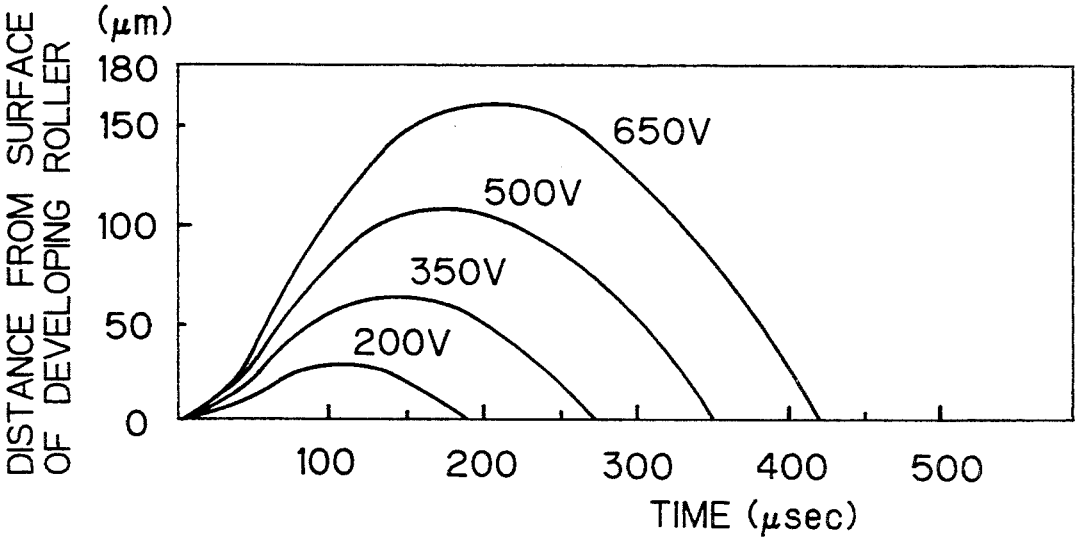
FIG. 11 is a graph representative of a distance which a toner flies in the gap and which changes with a change in potential difference between the pulse voltage and the potential of a non-image area, as determined by calculation.

Assume that the difference between the pulse voltage VPULS and the potential VD of the non-image area is changed with the duration TA of the pulse voltage VPULS maintained at 50 μsec. Then, under the same conditions as in FIG. 10, the distances which the toner flies were calculated by use of the Eq. (1), as shown in FIG. 11. As shown, when the above-mentioned potential difference |VPULS−VD| exceeds 700 V, the toner deposits on the non-image area of the photoconductor 1a. It was also found by experiments that as such a potential difference exceeds 700 V, background contamination by the toner is aggravated. On the other hand, when the potential difference is less than 100 V, the effect particular to the pulse voltage VPULS is not achievable. It follows that the difference between the pulse voltage VPUS and the potential of the non-image area should preferably range from 100 V to 700 V.

Figure 12:
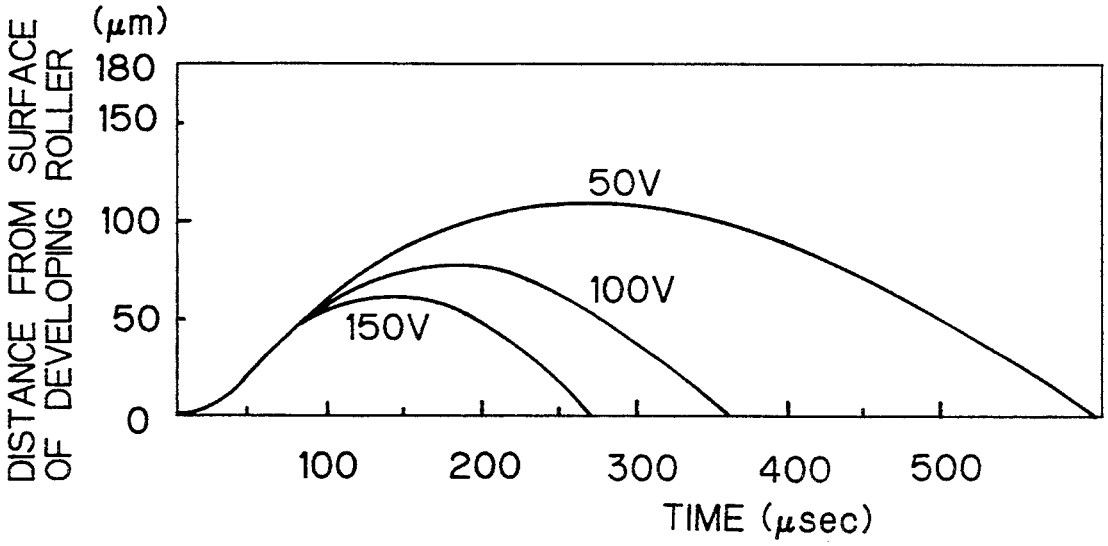
FIG. 12 is a graph representative of a distance which a toner flies in the gap and which changes with a change in potential difference between the DC voltage and the potential of a non-image area, as determined by calculation.

Further, assume that the difference between the DC voltage VDC and the potential VD of the non-image area is changed with the duration TA of the pulse voltage VPULS maintained at 50 μsec. Then, under the same conditions as in FIG. 10, the distances which the toner flies were calculated by use of the Eq. (1), as shown in FIG. 12. As shown, when the potential difference |VDC−VD| is less than 50 V, the toner stays in the gap for a long period of time, forming a cloud. Experiments also showed that as the potential |VDC−VD| decreases below 50 V, the toner cloud reduces the sharpness of the resulting image. On the other hand, when such a potential difference is greater than 500 V, the toner of first color 41 leaves the photoconductor 1a and returns to the developing roller of second color 75. Hence, the difference between the DC voltage VDC and the potential VD of the non-image area should preferably range from 50 V to 500 V.

Further, when the difference |VPULS−VDC| is greater than 600 V, the electric fields attributable to the pulse voltage VPULS noticeably influence the toner of first color 41 on the photoconductor 1*a*, causing the toner 41 to fly away from the photoconductor 1*a* toward the developing roller for the second color 75. When this potential difference is smaller than 300 V, the flight efficiency of the toner to the image area and the reverse flight efficiency of the toner from the non-image area are lowered. Hence, the difference |VPULS−VDC| should preferably lie in a range of from 300 V to 600 V.

Assume that the bias voltage VB is applied to the roller 75 carrying the toner of second color in a layer whose mean thickness is greater than 30 μm. Then, the outer periphery of the toner layer and the photoconductor 1*a* are so close to each other, the amount of toner to reach the non-image area increases. This aggravates background contamination. In addition, an excessive amount of toner deposits on the image area with the result that toner dust is conspicuous around lines. Hence, the mean thickness of the layer of the toner of second color on the roller 75 should preferably be less than 30 μm. It is to be noted that the words "mean thickness" refer to a mean thickness as measured by a laser beam, e.g., a mean value of thicknesses measured by a laser optics type noncontact surface configuration measuring system (available from UBM) at intervals of 10 μm.

When the mass of the toner of second color on the roller 75 for a unit area (M/A) exceeds 2.0 mg/cm$^2$, toner particles not sufficiently charged are introduced into the toner layer. Such toner particles oscillate on the application of the bias voltage VB and fly around to contaminate the interior of the apparatus. On the other hand, when the mass M/A decreases to below 0.5 mg/cm$^2$, the probability that the toner and the roller 75 contact each other increases. Then, adhesion due to frictional charging and, therefore, the electric field for causing the toner to leave the roller 75 (threshold electric field) is intensified. As a result, the effect available with the oscillation caused by the bias voltage VB is reduced, limiting the reproducibility of thin lines. The mass M/A, therefore, should preferably range from 0.5 mg/cm$^2$ to 2.0 mg/cm$^2$.

Regarding fine toner particles whose particle size is smaller than 3 μm, van der Waals' forces and liquid bridging forces are intensified relative to the electrostatic force. Hence, such particles tend to deposit on the roller 75 since they are difficult to fly despite the pulse voltage VPULS. When a toner containing this kind of particles in a great amount is used to effect development in the second color, the fine particles cover the surface of the roller 75 to weaken the electric fields in the developing region. As a result, the oscillation of the toner due to the pulse voltage VPULS is difficult to occur, limiting the reproducibility of thin lines. In light of this, the volumetric mean particle size of the toner of second color should preferably range from 3 μm to 15 μm; the ratio of particles smaller than 3 μm in size to the total toner should preferably be less than 20 number %.

Figure 13:
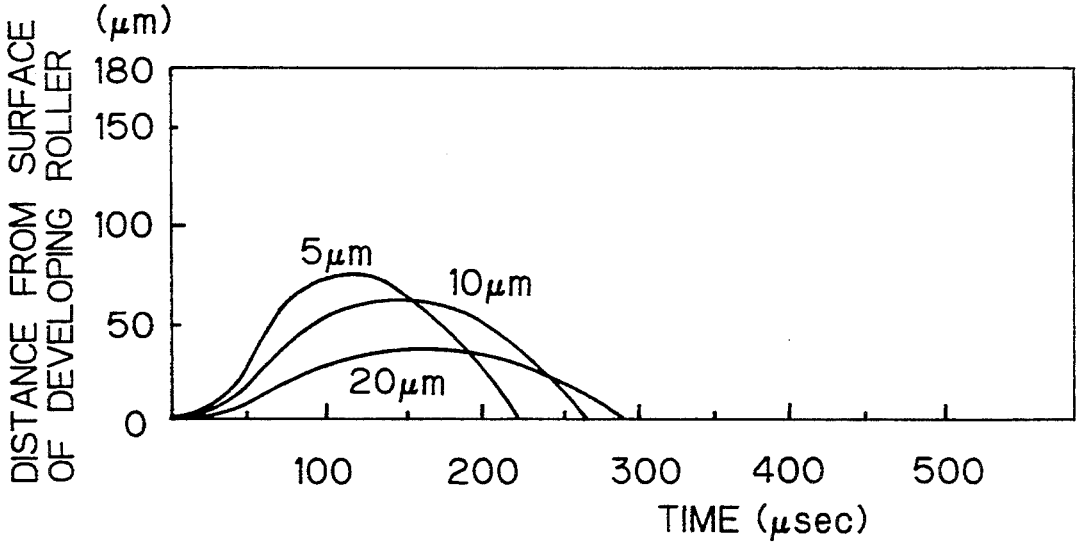
FIG. 13 is a graph representative of a distance which a toner flies in the gap and which changes with a change in the particle size of a toner of second color, as determined by calculation.

Assume that the electric fields derived from the bias voltage VB act on toner particles as great as 20 μm in particle size. Then, as shown in FIG. 13, a long period time is necessary for such great particles, once flown toward the photoconductor 1*a*, to be returned toward the roller 75 due to their inertia. As a result, the toner particles form a cloud in the gap, contaminating the interior of the apparatus. Therefore, the volumetric mean particle size of the toner of second color should range from 3 μm to 15 μm; the ratio of the particles greater than 20 μm in size should be less than 10 number %.

The degree of cohesion of a toner may be measured, as follows. Use is made of a powder tester (Integrated Powder Property Measuring Device, Type PT-E available from Hosokawa Micron). To begin with, among fittings included in the powder tester, (a) a vibroshoot, (2) a packing, (3) a space ring, (4) screens (upper, middle and lower), and (5) a retainer bar are sequentially set in this order. After the assembly has been fastened by nuts, a vibration table is operated under the following conditions:

(1) screen mesh size (upper): 75 μm
(2) screen mesh size (middle): 45 μm
(3) screen mesh size (lower): 22 μm
(4) graduation: 1 mm
(5) amount of sample: 10 g
(6) duration: 30 sec After the operation of the table, the weights of powder left on the individual screens are measured. The degrees of cohesion are determined by the following:

$$\frac{\text{amount of powder on upper screen}}{\text{amount of sample}} \times 100 \quad \text{(a)}$$

$$\frac{\text{amount of powder on middle screen}}{\text{amount of sample}} \times 100 \times 3/5 \quad \text{(b)}$$

$$\frac{\text{amount of powder on lower screen}}{\text{amount of sample}} \times 100 \times 1/5 \quad \text{(c)}$$

The degree of cohesion (%) is determined by summing up the three values (a), (b) and (c).

Hydrophobic silica is added to the outer periphery of the toner of second color. When the amount of this silica is smaller than 0.3 wt %, the toner strongly adheres to the surface of the roller 75 and is difficult to fly due to the bias voltage VB. When the amount of silica is greater than 2 wt %, much of the silica comes off the toner and floats in the toner hopper. Should the floating silica deposit on the roller 75, it covers the surface of the roller 75 since the electrostatic force and van der Waals' forces are stronger than the toner, preventing the electric fields due to the bias voltage VB from being formed. It follows that the amount of hydrophobic silica should range from 0.3 wt % to 2 wt %.

When the amount of charge deposited on the toner 41 of first toner 41 existing on the photoconductor 1*a* is small, the mirror force between the toner 41 and the photoconductor 1*a* decreases. In this condition, the toner 41 is susceptible to the electric fields to be formed by the bias voltage VB for the second color. As a result, the toner 41 is apt to fly away from the photoconductor 1*a* toward the roller 75, disturbing the image of first color and making the toner of second color impure. Preferably, therefore, the amount of charge to deposit on the toner 41 should be greater than 20 μc/g. It is to be noted that the upper limit of this charge is about 50 μc/g lying in a range developable at the present stage.

When the particle size of the toner of first color 41 existing on the photoconductor 1*a* is great, the mirror force between it and the photoconductor 1*a* decreases. In this condition, the toner 41 is susceptible to the electric fields to be formed by the bias voltage VB for the second color. As a result, the toner 41 is apt to fly away from the photoconductor 1*a* toward the roller 7, disturbing the image of first color and making the toner of second color impure. Hence, the particle size of the toner 41 should preferably be smaller than 10 μm. The lower limit of this particle size is about 4 μm in the developable range.

When the degree of cohesion of the toner of first color before development is brought out of a predetermined range, the adhesion thereof to the photoconductor 1*a* (van der Waals' forces due to the adhesion between particles, liquid bridging, etc.) decreases in the event of development. Then, the toner 41 is susceptible to the electric fields to be generated by the bias voltage VB for the second color. As a result, the toner 41 is apt to fly away from the photoconductor 1*a* toward the roller 75, disturbing the image of first color and making the toner of second color impure. Moreover, the toner 41 is brought out of the range developable at the present stage. Hence, the degree of cohesion of the toner 41 before development should preferably range from 15% to 50%. The degree of cohesion of the toner 41 is measured by the previously stated screening method using a powder tester.

Other approaches are available for preventing the image of first color from being disturbed and preventing the toner of first color from being mixed with the toner of second color, as follows. For example, the particle size or the amount of an agent to be added to the outer periphery of the toner of first color 41 may be reduced. Then, the van der Waals' forces to act on the toner 41 existing on the photoconductor 1*a* will be greater than the electrostatic force to be formed by the electric fields for the second color.

As stated above, the toner of first color 41 should preferably have such a characteristic that the attraction acting between the toner 41 and the photoconductor 1*a* (mirror force plus van der Waals' forces) is not susceptible to the electric fields to be formed by the bias voltage for the second color. In this respect, a developing system using a two component type developer (toner 41 plus carrier), as in the embodiment, is desirable for the development in the first color.

Figure 14:
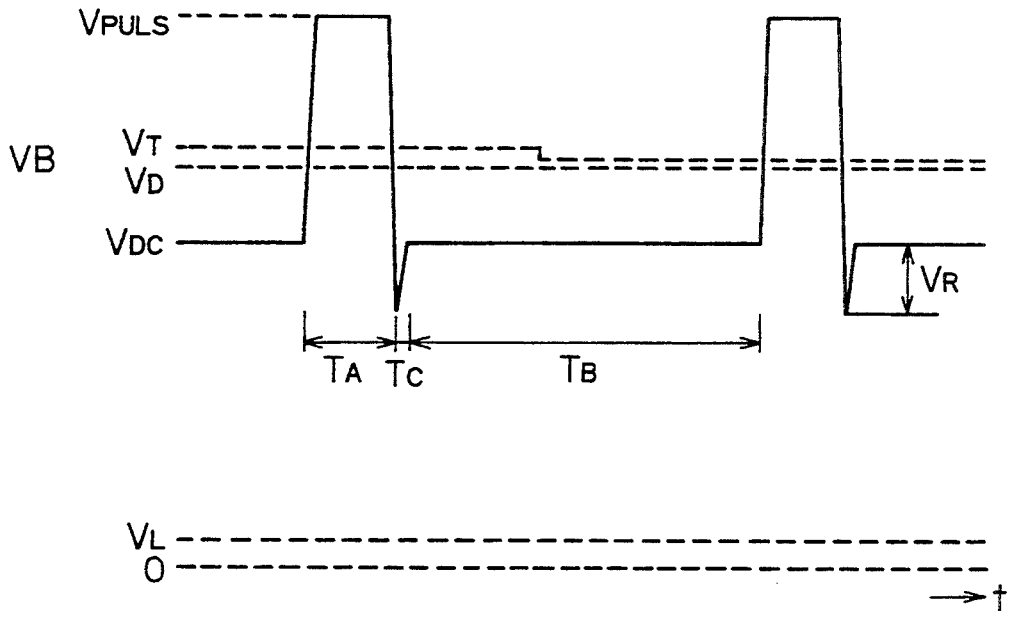
FIGS. 14 and 15 each shows another specific waveform of the bias voltage.

As shown in FIG. 14, the bias voltage VB for the second color may include an overshoot portion (duration of TC) at the negative-going edge of the pulse voltage VPULS. The duration TC of the overshoot portion should be shorter than 50 μm, preferably about 10 μm to about 20 μm, so as not to affect the toner image of first color existing on the photoconductor 1*a*. In addition, the difference between the peak voltage of the overshoot and the DC voltage VDC should be greater than 50 V. By applying the bias voltage VB with such an overshoot portion to the roller 75, it is possible to decelerate the toner 71, floated above the roller 75 due to the pulse voltage VPULS, by reverse electric fields sharply generated by the overshoot portion. As a result, the toner 71 is returned to the roller 75 rapidly without forming a cloud in the gap. Another advantage is that the amplitude of the electric fields in the gap is increased to cause the toner 71 to vibrate more actively on the roller 75 and be loosened.

Figure 15:
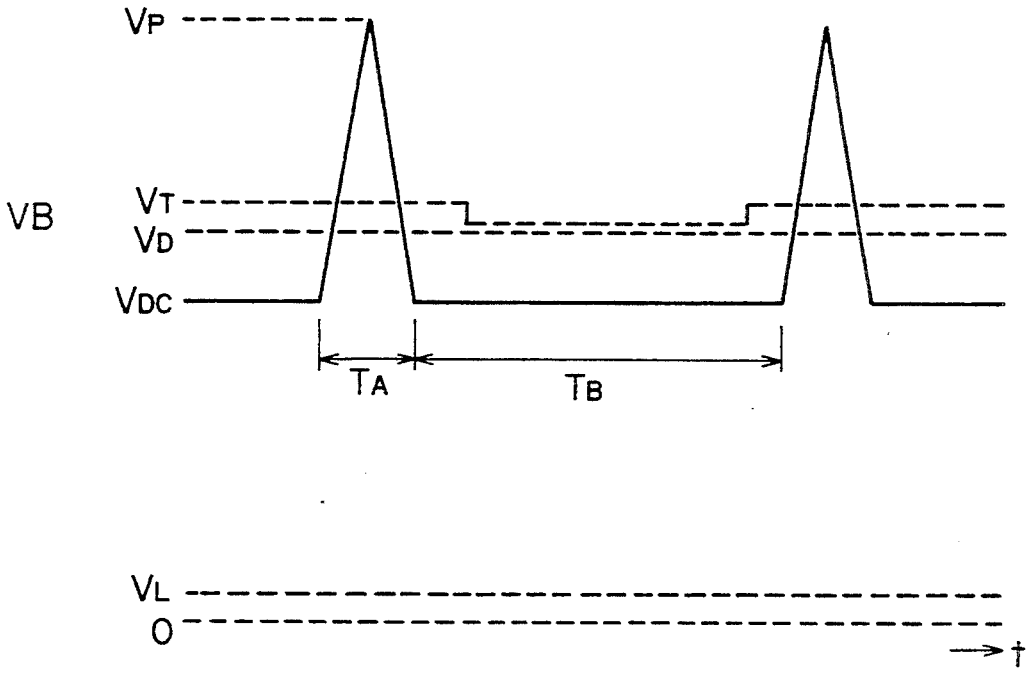

As shown in FIG. 15, the bias voltage VB for the second color may be implemented as a voltage having a triangular waveform whose peak value is VP, and a DC voltage VDC. The voltage having a triangular wave and the DC voltage VDC are respectively applied for the first period TA and the second period TB. In this kind of scheme, during the first period TA, the toner of second color 71 starts flying toward the photoconductor 1*a* without regard to the image/non-image area. During the second period TB, the toner 71 flying toward the image area of the photoconductor 1*a* reaches it, while the toner 71 flying toward the non-image area is returned to the roller 75. The voltage applied during the period TA reduces the effective voltage more than a pulse voltage for the same peak voltage VP. As a result, the distance which the toner 71 travels from the roller 75 toward the non-image area of the photoconductor 1*a* decreases, further suppressing background contamination. In addition, such a voltage, like a pulse voltage, causes oscillation to be imparted to the toner 71, thereby insuring a smooth image. The voltage having a triangular waveform simplifies the construction of the bias power source 77 since the positive- and negative-going edges thereof should not be as sharp as those of a pulse voltage. However, should the positive- or negative-going edge of the triangular voltage be slower than 5 V/μsec, the electric fields for returning the toner 71 to the roller 75 would be delayed and would cause it to reach the photoconductor 1*a*, bringing about background contamination. In light of this, the positive- and negative-going edges of such a voltage should preferably be sharper than 5 V/μsec.

Hereinafter will be described specific examples of the illustrative embodiment.

[EXAMPLE 1]

The photoconductor 1*a* was implemented by a negatively chargeable organic photoconductor. Both the toner of first color 41 and the toner of second color 71 were negatively chargeable and subjected to negative-to-positive development. The developing unit for the second color 7 was provided with a gap of 0.18 mm for development. The photoconductor 1*a* was rotated at a linear velocity of 120 mm/sec while the roller 75 was rotated at a 1.2 times higher linear speed than the photoconductor 1*a*. The toner image of first color, the toner image of second color, and the background respectively had potentials of −800 V to −900 V (VT), about −100 V (VL), and about −91 V (VD). The bias voltage for development VB had, in one period thereof, a pulse voltage (VPULS) whose peak voltage was −1200 V and duration was 50 μsec, and a DC voltage (VDC) of −700 V. Such a bias voltage VB was applied to the roller 75 at a repetition frequency of 2 kHz.

This example produced a desirable image of second color having clear-cut lines and smooth halftone portions, without disturbing an image of first color existed on the photoconductor 1*a*. In addition, the toner of first color 41 was sparingly introduced into the developing unit for second color 7.

[EXAMPLE 2]

Example 1 was repeated except that the linear velocity of the photoconductor 1*a* was 200 mm/sec, and the background potential (VD) was −900 V. This example was found comparable with Example 1 in respect of advantages.

[EXAMPLE 3]

Example 1 was repeated except for the following. A 20 μm thick toner layer was formed on the roller 75 for the development in the second color. The developing unit for the second color 7 was provided with a gap of 0.12 mm. The photoconductor 1*a* was moved at a linear velocity of 200 mm/sec while the roller 75 was moved at a 1.1 times higher linear velocity than the photoconductor 1*a*. The pulse voltage (VPULS) had a duration of 80 μsec. This example was also successful in achieving the advantages described in relation to Example 1.

[EXAMPLE 4]

Example 1 was repeated except for the following. The toner of second color deposited on the roller 75 had a mass per unit area (M/A) of 1.2 mm/cm$^2$. The developing unit for the second color 7 was provided with a gap of 0.15 min. The photoconductor 1*a* was rotated at a linear velocity of 200 mm/sec while the roller 75 was rotated at a 1.1 times higher linear velocity than the photoconductor 1*a*. The pulse voltage (VPULS) had a peak voltage of −1300 V. This example was also comparable with Example 1 in respect of advantages.

[EXAMPLE 5]

Example 1 was repeated except for the following. The nonmagnetic toner of second color had a volumetric mean particle size of 10 μm; the ratio of fine particles smaller than 3 μm was 8 number %. The developing unit 7 for the second color was provided with a gap of 0.15 mm. The photoconductor 1*a* was moved at a linear velocity of 200 mm/sec while the roller 75 was moved at a 1.1 times higher linear velocity than the photoconductor 1*a*. This example produced an image of second color which is highly reproducible and free from background contamination. In addition, the toner of first color was sparingly introduced into the developing unit for the second color 7. For comparison, when the ratio of fine particles smaller than 3 μm was increased to 22 number % with the other conditions maintained the same, the amount of toner flown to an image portion was too short to render thin lines.

[EXAMPLE 6]

Example 5 was repeated except that the nonmagnetic toner of second color contained particles greater than 20 μm in size in a ratio of 1 number %. This example was found comparable with Example 5 in respect of advantages.

[EXAMPLE 7]

The photoconductor 1*a* was implemented by a negatively chargeable organic photoconductor. Negative-to-positive development was effected by use of the first and second toners 41 and 71 both of which were negatively chargeable. The nonmagnetic toner of second color was measured to have a degree of cohesion of 12%, as measured by screening. The developing unit for the second color 7 had a gap of 0.15 mm. The photoconductor 1*a* was moved at a linear velocity of 200 mm/sec while the roller 75 was moved at a 1.1 times higher linear velocity than the photoconductor 1*a*. Regarding the potentials VT, VL and VD and the bias voltage VB, this example is identical with Example 1. This example produced a desirable image of second color having a smooth halftone portion without disturbing the toner image of first color existed on the photoconductor 1*a*. In addition, the toner of first color was sparingly introduced into the developing unit for the second color 7. For comparison, when a toner tending to cohere was used with the other conditions maintained the same, granularity was noticeable in a halftone portion. The degree of cohesion was 21%.

[EXAMPLE 8]

The photoconductor 1*a* was implemented by a negatively chargeable photoconductor. Negative-to-positive development was effected by use of the first and second toners 41 and 71 which were negatively chargeable. The nonmagnetic toner for the development in the second color had hydrophobic silica added to the outer periphery thereof in an amount of 0.7%. The developing unit for the second color 7 had a gap of 0.15 mm. The photoconductor 1*a* was moved at a linear velocity of 200 mm/sec while the roller 75 was moved at a 1.1 times higher linear velocity than the photoconductor 1*a*. Regarding the potentials VT, VL and VD and the bias voltage VB, this example is identical with Example 1. This example produced an image of second color having sufficient density without disturbing a toner image of first color existed on the photoconductor 1*a*. In addition, the toner of first color was sparingly introduced into the developing unit for the second color 7. For comparison, when use was made of a toner carrying the hydrophobic silica on the outer periphery thereof in an amount of 0.2%, the toner failed to fly to an image area sufficiently, and the resulting image was low in density. When the amount of hydrophobic silica on the outer periphery of the toner was 2.2%, the silica was accumulated on the roller 75 without being consumed. This obstructed the flight of the toner and also resulted in short image density.

[EXAMPLE 9]

Example 1 was repeated except for the following the background potential (VD) and latent image potential (VL) for the first color were about −900 V and about −100 V, respectively. The potential (VT) of the toner image of first color was about −900 V. The latent image potential (VL) for the second color was about −100 V while the background potential (VD) was about −900. The toner 41 of first color was implemented by a toner having the previously stated charge, particle size and cohesion characteristics. This example was as successful as Example 1 in respect of image quality and prevention of color mixture.

[EXAMPLE 10]

Example 1 was repeated except for the following. The photoconductor 1*a* was moved at a linear velocity of 200 mm/sec while the roller 75 was moved at a 1.1 times higher linear velocity than the photoconductor 1*a*. The bias voltage VB had, in one period thereof, a pulse voltage (VPULS) having a peak voltage of −1300 V, a duration of 60 μsec and an overshoot portion at a negative-going edge which had a peak voltage of −600 V and a duration of 10 μsec, and a DC voltage (VDC) of −700 V. The bias voltage VB was applied at a repetition frequency of 2.5 kHz. This example was also as successful as Example 1 in respect of image quality and prevention of color mixture.

[EXAMPLE 11]

The photoconductor 1*a* was implemented by positively chargeable selenium. Negative-to-positive development was effected by use of toners of first and second colors which were positively chargeable. The developing unit for the second color 7 had a gap of 0.18 mm. The photoconductor 1*a* was moved at a linear velocity of 120 mm/sec while the roller 75 was moved at a 1.2 times higher linear velocity than the photoconductor 1a. A toner image of first color had a potential (VT) of +800 V to +900 V. A latent image of second color had a potential (VL) of about +100 V, and the background potential (VD) was about +910 V. The bias voltage VB had, in one period thereof, a voltage having a triangular waveform, and a DC voltage (VDC) OF +700 V. The voltage having a triangular waveform had a peak voltage of +1300 V and a rising time and a falling time of 100 μsec. Such a bias voltage VB was applied at a repetition frequency of 2 kHz. This example was also as successful as Example 1 in respect of image quality and prevention of color mixture.

Figure 16:
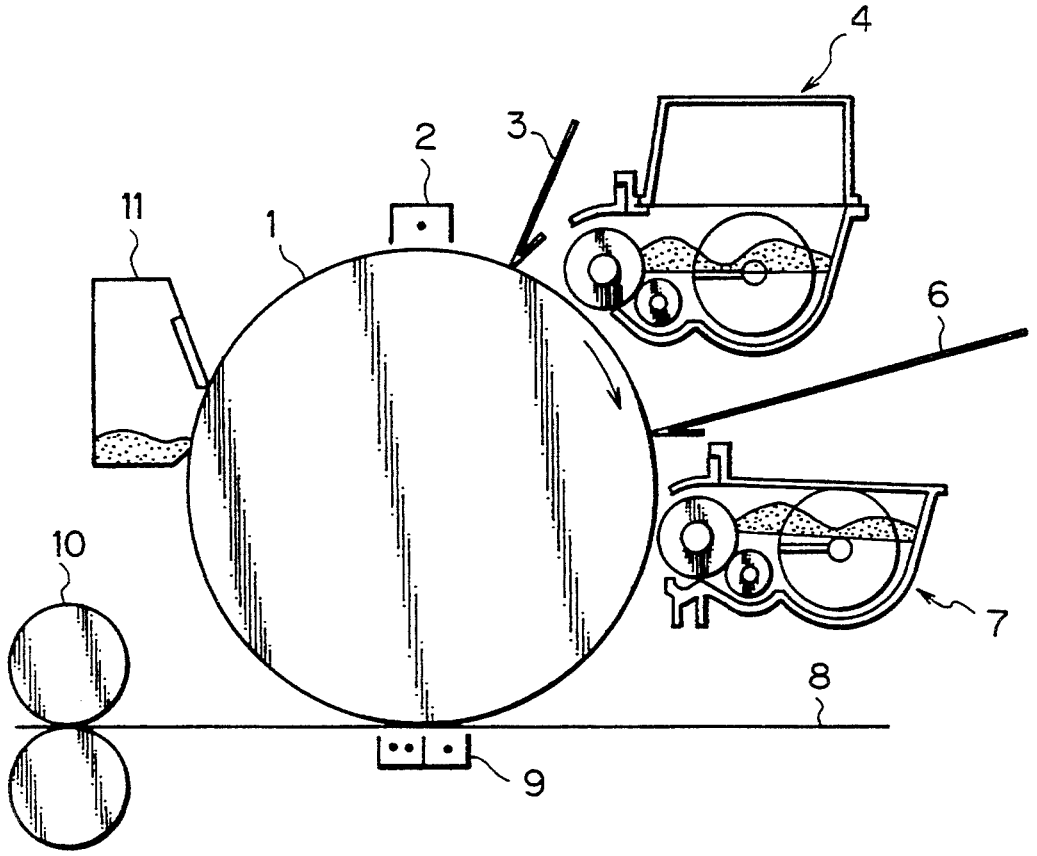
FIG. 16 is a front view of a copier representative of an alternative embodiment of the present invention.

An alternative embodiment of the present invention will be described with reference to FIG. 16. In this embodiment, the toners of first and second colors 41 and 71, respectively, are different in polarity from each other. Specifically, for the development in the first color, the toner 41 sharing the same polarity with the drum 1 was used to effect negative-to-positive development. For the development in the second color, the toner 71 opposite in polarity to the drum 1 was used to effect positive-to-positive development. In FIG. 16, the same or similar constituent parts as the parts shown in FIG. 2 are designated by the same reference numerals.

Figure 17A:
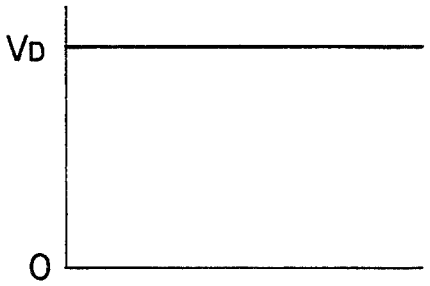
FIGS. 17A–17E each shows a potential deposited on a photoconductive element included in the alternative embodiment after a particular image forming step.
Figure 17B:
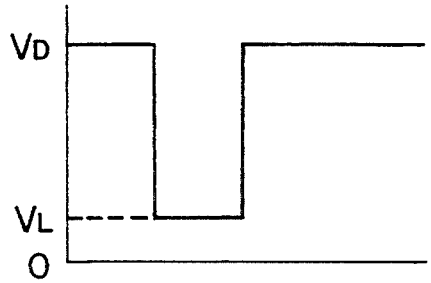
Figure 17C:
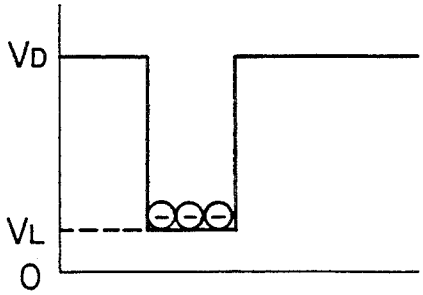
Figure 17D:
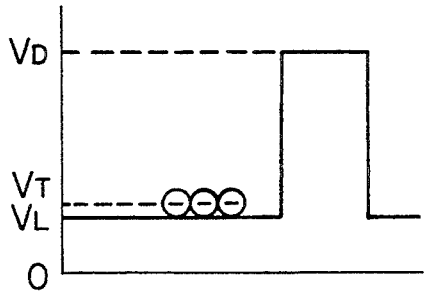
Figure 17E:
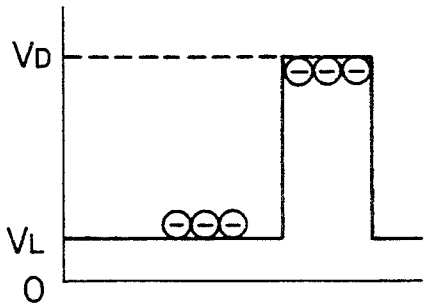

Referring to FIGS. 17A–17E, the operation of this embodiment will be outlined. To begin with, the first charger 2 uniformly charges the surface of the drum 1 to the polarity VD, as shown in FIG. 17A. The first optics 3 forms a first latent image electrostatically on the drum 1, as shown in FIG. 17B. At this instant, the image portion of the first latent image has the potential VL. Subsequently, the first developing unit 4 develops the first latent image to form a corresponding toner image of first color, as shown in FIG. 17C. Thereafter, as shown in FIG. 17D, the second optics 6 forms a second latent image to be subjected to positive-to-positive development. It should be noted that the second charging step is not performed between the steps shown in FIGS. 17C and 17D. Finally, the second developing unit 7 develops the second latent image, as shown in FIG. 17E.

Figure 18:
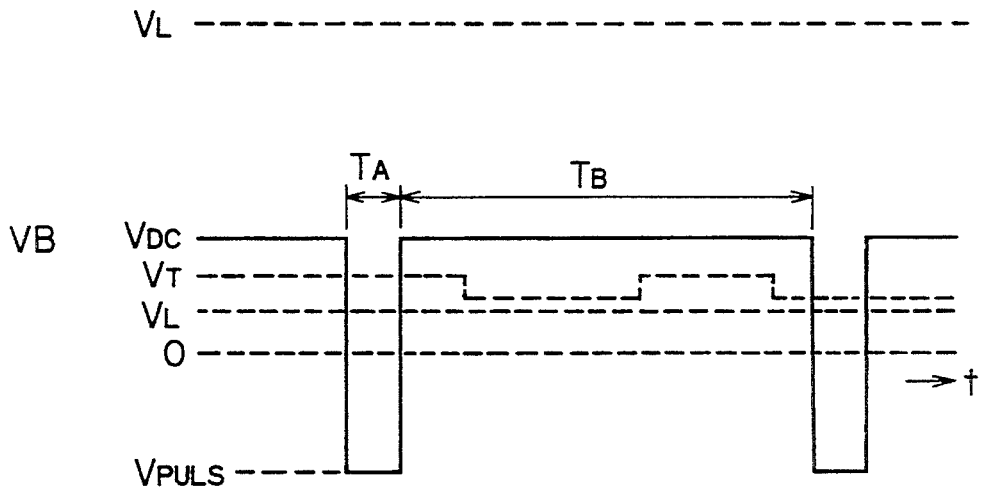
FIG. 18 shows a specific waveform of a bias voltage particular to the alternative embodiment.

In the illustrative embodiment, when the second developing unit 7 performs development with the toner 71, a bias voltage VB shown in FIG. 18 is applied. As shown, the bias voltage VB consists of a pulse voltage, or first voltage, VPULS applied for a period of time, or first period, TA, and a DC voltage, or second voltage, VDC applied for a period of time, or second period, TB. The pulse voltage VPULS and DC voltage VDC constitute one period of the bias voltage VB. The bias voltage VB, therefore, changes periodically. In FIG. 18, the abscissa indicates time (t). The pulse voltage VPULS is opposite in polarity to the potentials VL and VD of the image and non-image areas of the drum 1 and is selected in such a manner as to set up a sufficiently high developing potential at each of the areas of the drum 1. The DC voltage VDC is greater in absolute value than the potential VT of the toner layer of first color formed on the drum 1 and the potential VL of the non-image area and is smaller in absolute value than the potential VD of the image portion. This is successful in setting up a sufficiently high developing potential.

In the embodiment, the duration of the pulse voltage VPULS is selected to be shorter than 100 μsec. One period of the bias voltage VB is longer than 200 μsec, i.e., the repetition frequency of one period is lower than 5 kHz. Further, the gap for development is 100 μm to 300 μm.

As stated above, in the illustrative embodiment, the pulse voltage VPULS for the development in the second color causes the toner 71 to fly from the roller 75 toward the drum 1 without regard to the image/non-image area of the drum 1. At this instant, the electric field distribution shown in FIG. 7A occurs in the gap (although the orientation is opposite). The resulting intense electric fields prevent the thickness of latent line images on the drum 1 from being degraded. Further, since the toner 71 floated away from the roller 75 flows along the electric fields faithfully, thin lines are also reproduced in a desirable manner.

Figure 19:
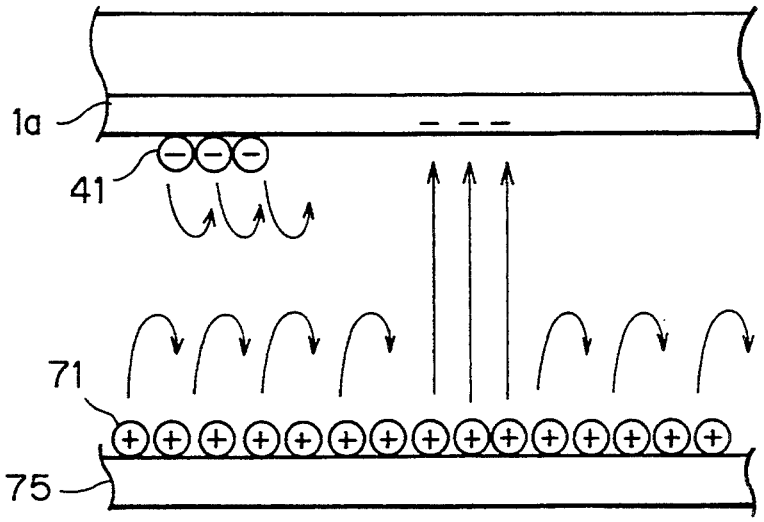
FIG. 19 shows how a toner flies in the gap when a DC voltage included in the bias voltage of FIG. 18 is applied.

On the other hand, when the DC voltage VDC is applied, the toner 71 flying toward the non-image area of the drum 1 is returned to the roller 75 without reaching the drum 1, as shown in FIG. 19. At the same time, the toner 71 flowing toward the image area of the drum 1 reaches it and forms and image, as also shown in FIG. 19. In FIG. 19, the toner 71 is a toner layer of second color formed on the roller 75, while the toner 41 is a toner image of first color formed on the drum 1.

Also, in accordance with the illustrative embodiment, the toner 71 is loosened on the roller 75 by being caused to oscillate. As a result, even a low contrast portion can be reproduced with smoothness.

In the event of development in the second color, the toner 71 is prevented from flying back and forth in the gap for development, while hitting against the surface of the photoconductor 1a. This protects the toner image of first color existing on the photoconductor 1a and, in addition substantially eliminates an occurrence that the toner of first color 41 comes off the photoconductor 1a and flies into the developing unit for the second color 71, making the toner of second color 71 turbid.

The repetition frequency of the bias voltage VB is lower than 5 kHz. Hence, when the toner 71 floated away from the roller 75 is returned toward the roller 75, electric fields for causing it to again fly toward the drum 1 are formed. This prevents the toner 71 from forming a cloud in the gap and, therefore, insures a sharp image.

Since the gap for development is greater than 100 μm, the toner of second color 71 is more positively prevented from reaching the non-image area of the drum 1. As a result, background contamination is surely prevented from occurring. Since the gap is smaller than 300 μm, there is obviated an occurrence that electric fields are difficult to form and cause an image to become unclear.

Although electric fields tending to cause the toner of first color 41 to reversely fly from the drum 1 toward the roller 75 act during the period of time TA, the toner 41 is successfully returned to the drum 1 without reaching the roller 75.

The toners 41 and 71 of first and second colors, respectively, should preferably be implemented by toners having particular characteristics described in relation to the previous embodiment (negative-to-positive development in both of the first and second colors).

Again, the bias voltage VB for the second color may include an overshoot portion (duration TC) at the negative-going edge of the pulse voltage VPULS. Further, a voltage having a triangular waveform, which has a peak voltage VP, and a DC voltage VDC may be respectively applied over the first and second periods TA and TB.

Specific examples of this embodiment will be described hereinafter.

[EXAMPLE 12]

The photoconductor 1*a* was implemented by a negatively chargeable organic photoconductor. The toner 41 was negatively chargeable and effected negative-to-positive development in the first color. The toner of second color 71 was positively chargeable and effected positive-to-positive development. The developing unit for the second color 7 had a gap of 0.16 mm. The photoconductor was moved at a linear velocity of 120 mm/sec while the roller 75 was moved at a 1.1 times higher linear velocity than the photoconductor 1*a*. The toner image of first color had a potential VT of −110 V to −160 V while the latent image of second color had a potential VD of about −850 V. The background potential VL was about −100 V. The bias voltage VB had one period constituted by a pulse voltage VPULS having a peak voltage of +250 V and a duration of 50 μsec, and a DC voltage VDC of −250 V. The bias voltage VB was applied at a repetition frequency of 2 kHz.

This embodiment produced a desirable image of second color having clear-cut lines and smooth halftone portions without disturbing the toner image of first color existed on the photoconductor 1*a*. In addition, the toner of first color 41 was sparingly introduced into the developing unit for the second color 7.

[EXAMPLE 13]

Example 12 was repeated except for the following. The bias voltage VB had one period constituted by a pulse voltage VPULS having a peak voltage of +250 V, a duration of 50 μsec and an overshoot portion at the negative-going edge whose peak voltage was −400 V and duration was 20 μsec, and a DC voltage VDC of −250 V. Such a bias voltage VB was applied at a repetition frequency of 2 kHz. This example was comparable with Example 12 in respect of advantages.

[EXAMPLE 14]

The photoconductor 1*a* was implemented by selenium. The toner of first color 41 was positively chargeable and effected negative-to-positive development. The toner of second color 71 was negatively chargeable and effected positive-to-positive development. The gap for the second color was 0.16 min. The photoconductor was moved at a linear velocity of 120 mm/sec while the roller 75 was moved at a 1.1 times higher linear velocity than the photoconductor 1*a*. The toner image of first color had a potential VT of +110 V to +160 V while the latent image of second color had a potential of about +850 V. The background potential was about +100 V. The bias voltage VB had one period constituted by a voltage having a triangular waveform whose peak voltage was −300 V and a rising time and a falling time were 100 μsec, and a DC voltage VDC of −250 V. Such a bias voltage VB was applied at a repetition frequency of 2 kHz. This example was also as successful as Example 1 in respect image quality and prevention of color mixture.

It should be noted that the specific conditions included in the embodiment, of course, hold in combination with the predetermined charge polarity of the drum 1, i.e., without regard to the polarity of toners.

As the embodiments shown and described indicate, the present invention is applicable to both the case wherein the toners 41 and 71 are of the same polarity and effect negative-to-positive development, and the case wherein they are of different polarities and effect negative-to-positive development and positive-to-positive development, respectively.

The embodiments have concentrated on the non-contact type developing unit 7 having the roller 75 in which the dielectric particles 75*c* are buried in the conductive resin 75*b* and appear on the surface of the roller 75. However, the present invention is similarly applicable to a multicolor image forming apparatus having a non-contact type developer having, for example, a simple developing roller lacking the conductive portion, or resin, 75*b* and dielectric portions, or particles, 75*c*.

In summary, it will be seen that the present invention provides a multicolor image forming apparatus having various unprecedented advantages, as enumerated below.

(1) During a first period of a bias voltage for the second and successive colors, a first voltage is applied to a developer carrier to generate predetermined electric fields, e.g., intense electric fields oriented toward the image carrier, as shown in FIG. 7A, in a gap between the developer carrier and an image carrier. This prevents the thickness of latent line images from being degraded on the image carrier. A developer floated away from the developer carrier flies toward the image and non-image areas of the image carrier along the intense electric fields faithfully, thereby reproducing even thin lines accurately. The first period is so determined as to prevent the developer from reaching the non-image area. During a second period which follows the first period, a second voltage is applied to the developer carrier to generate predetermined electric fields in the gap. The second voltage causes the developer on the developer carrier to fly toward the image portion and causes the developer flying toward the non-image portion to start returning and reach the developer carrier. Hence, images with clear background are achievable. Further, since the developer is prevented from flying back and forth between the developer carrier and the image carrier while hitting against them, a developer layer existing on the image carrier is free from disturbance. Since the developer oscillates on the developer carrier, it is prevented from cohering with the result that a smooth image is insured even in a low contrast portion. Moreover, the second voltage is so selected as to generate electric fields which prevent the developer existing on the image carrier from leaving it. This, coupled with the fact that the first period is so selected as to prevent the developer existing on the image carrier from flying toward and reading the developer carrier, prevents the developer from entering developing means assigned to the second and successive colors. Consequently, color mixture in the second and successive developing means is obviated.

(2) The repetition frequency of the bias voltage is lower than 5 kHz. Hence, when the developer floated away from the developer carriers is returned toward the developer carrier, it is sufficiently returned to the developer carrier. This prevents the developer from forming a cloud in the gap and, therefore, insures a sharp image.

(3) An overshoot portion included in the bias voltage sharply forms a reverse electric field which returns the developer floated away from the developer carrier to the developer carrier rapidly. This eliminates toner clouds and, therefore, insures a sharp image. Since the amplitude of oscillatory electric fields is increased, the developer is caused to oscillate more actively on the developer carrier and loosened thereby. The resulting image is smooth even in a low contrast portion.

(4) When the first voltage of the bias voltage is implemented by a voltage having a triangular waveform, it reduces the effective voltage within the first period more than a rectangular pulse voltage for the same peak voltage. As a result, the distance which the developer flies from the developer carrier toward the non-image area of the image carrier is reduced, so that background contamination is suppressed more positively. Further, the triangular voltage allows the positive- and negative-going edges thereof changed smoothly, compared to a rectangular pulse voltage, thereby simplifying the construction of bias voltage applying means. In addition, since the triangular voltage is designed to change at a rate of 5 V/μsec at the positive- and negative-going edges thereof, electric fields for returning the developer moving toward the non-image portion are generated rapidly. Hence, such a developer is surely prevented from reaching the image carrier.

(5) The second period is longer than 200 μsec while the difference between the second voltage and the potential of the non-image area of the image carrier is greater than 50 V in absolute value. Therefore, when the developer floated away from the developer carrier and flying toward the image carrier is returned toward the developer carrier, it is allowed to reach the image carrier without fail and does not form a cloud in the gap. This also insures sharp images.

(6) For the development in the second and successive colors, the developer forms on the developer carrier a layer having a mean thickness less than 30 μm. This prevents the distance between the surface layer of the developer layer and the surface of the image carrier from decreasing; otherwise, the amount of developer reaching the non-image area of the image carrier would increase. As a result, background contamination is prevented from being aggravated. Furthermore, since the image area is prevented from being developed excessively, developer dust around lines is not noticeable.

(7) For the development in the second and successive colors, the developer forms on the developer carrier a layer having a mass for a unit area greater than 0.5 mg/cm$^2$. This reduces the probability that the developer and the developer carrier contact each other and, therefore, a frictional attracting force. Consequently, the electric field for causing the developer to leave the surface of the developer carrier (threshold voltage) is lowered. Hence, the effect available with the oscillation of the developer caused by the first and second voltages is not degraded, so that thin lines can be desirably reproduced. When the mass of the developer layer for a unit area is less than 2.0 mg/cm$^2$, developer particles not sufficiently charged are prevented from being introduced into the developer layer. The developer, therefore, does not fly around when the first voltage is applied. As a result, the interior of the apparatus is free from contamination.

(8) For the development in the second and successive colors, use is made of a developer whose volumetric mean particle size is 3 μm to 15 μm, while the ratio of developer particles smaller than 3 μm to the entire developer is lower than 20 number %. Such fine particles are prevented from covering the surface of the developer carrier and weakening the electric fields in the gap. Hence, on the application of the first voltage, the developer flies toward the image carrier and, therefore, oscillates. Consequently, thin lines can be reproduced in a desirable manner.

(9) For the development in the second and successive colors, use is made of a developer whose volumetric mean particle size is 3 μm to 15 μm as measured on the developer carrier, while the ratio of developer particles greater than 20 μm in size to the entire developer is lower than 10 volume %. In this condition, the developer flying toward the image carrier is returned to the developer carrier within a short time and, therefore, does not form a cloud in the gap. This not only insures a sharp image but also protects the interior of the apparatus from contamination.

(10) For the development in the second and successive colors, use is made of a developer having a degree of cohesion less than 20%. In this condition, the first and second voltages loosen the developer particles easily, insuring smooth images.

(11) For the development in the second and successive colors, use is made of a developer to the outer periphery of which hydrophobic silica is added in an amount greater than 0.3 wt %. This prevents the developer from strongly adhering to the developer carrier. Hence, the first voltage allows the developer to start flying toward the image carrier easily. When the amount of hydrophobic silica is smaller than 2.0 wt %, the developer carrier is prevented from being covered with the floating silica, so that the electric fields in the gap are prevented from being weakened. As a result, the first voltage allows the developer to fly toward the image carrier and insures the usual oscillation of the developer.

(12) The surface of the developer carrier is made up of a plurality of portions each having a particular dielectric constant, e.g., a conductive portion connected to ground, and minute dielectric portions dispersed in the conductive portion and appearing on the surface of the developer carrier. In this configuration, the first voltage generates intense electric fields in the conductive portion and, therefore, moves a greater amount of developer than in the dielectric portions. As a result, the developer deposited on the conductive portions are easy to fly even toward the low contrast portions of an image; the developer deposited on the dielectric portions fly only toward high contrast portions. Consequently, an image with excellent tonality is achievable.

(13) During the development in the second and successive colors, the adhesion of the developer existing on the image carrier to the latter is not susceptible to the electric fields generated in the gap by the bias voltage. This prevents the developer on the image carrier from flying away from the image carrier into the second and successive developing means. Consequently, not only the image existing on the image carrier is protected from disturbance, but also color mixture is eliminated in the second and successive developing means.

Various modifications will become possible for those skilled in the art after receiving the teachings of the present disclosure without departing from the scope thereof.

What is claimed is:

1. In a multicolor image forming apparatus for forming a visible multicolor image on an image carrier and then transferring said visible multicolor image to a transfer medium at one time;

developing means respectively assigned to a second and successive colors each comprising:

a developer carrier for carrying a one component type developer on a surface thereof; and bias voltage applying means for applying to said developer carrier a periodically changing bias voltage having one period consisting of a first period of time and a second period of time;

said bias voltage applying means applying for said first period of time a first voltage which generates in a gap between said image carrier and said developer carrier an electric field for causing the developer to fly toward an image area and a non-image area of said image carrier;

said bias voltage applying means applying for said second period of time a second voltage which generates in said gap an electric field for returning the developer flying toward said non-image area toward said developer carrier and for preventing the developer existing on said image carrier from leaving said image carrier;

said first period of time being selected such that the developer does not reach said non-image area while the developer existing on said image carrier does not fly toward and reach said developer carrier.

2. An apparatus as claimed in claim 1, wherein said first voltage and said second voltage comprise a pulse voltage and a DC voltage, respectively;

said second voltage being selected such that a potential difference between said second voltage and a potential of the developer existing on said image carrier is smaller than 500 V in absolute value;

said first period of time being shorter than 100 μsec;

one period of said bias voltage having a repetition frequency of lower than 5 kHz;

said developer carrier and said image carrier having a shortest distance ranging from 100 μm 300 μm therebetween.

3. An apparatus as claimed in claim 1, wherein said first voltage and said second voltage comprise a pulse voltage and a DC voltage, respectively;

said pulse voltage having an overshoot portion at a negative-going edge thereof, a potential difference between a peak voltage of said overshoot portion and said DC voltage being greater than 50 V.

4. An apparatus as claimed in claim 1, wherein said first voltage and said second voltage comprise a voltage having a triangular waveform and a DC voltage, respectively;

said voltage having a triangular waveform changing at a rate higher than 5 V/μsec at each of a positive- and a negative-going edge thereof.

5. An apparatus as claimed in claim 1, wherein said first voltage and said second voltages comprise a pulse voltage and a DC voltage, respectively;

said first voltage being selected such that a potential difference between said first voltage and a potential of said non-image area ranges from 100 V to 700 V in absolute value;

said second voltage being selected such that a potential difference between said second voltage and the potential of said non-image area ranges from 50 V to 500 V in absolute value;

said first period of time being shorter than 100 μm;

said second period of time being longer than 200 82 sec;

said developer carrier and said image carrier having a distance ranging from 100 μm to 300 μm therebetween.

6. An apparatus as claimed in claim 1, wherein for development in the second and successive colors, the developer forms on said developer carrier a layer having a mean thickness less than 30 μm.

7. An apparatus as claimed in claim 1, wherein for development in the second and successive colors, the developer forms on said developer carrier a layer having a mass per unit area of 0.5 mg/cm$^2$ to 2.0 mg/cm$^2$.

8. An apparatus as claimed in claim 1 wherein for development in the second and successive colors, the developer has a volumetric mean particle size of 3 μm to 15 μm, and a ratio of particles smaller than 3 μm in size to the entire developer is less than 20 number %.

9. An apparatus as claimed in claim 1, wherein for development in the second and successive colors, the developer has a volumetric mean particle size of 3 μm to 15 μm as measured on said developer carrier.

10. An apparatus as claimed in claim 1, wherein for development in the second and successive colors, the developer has a degree of cohesion of less than 20%.

11. An apparatus as claimed in claim 1, wherein for development in the second and successive colors, the developer has hydrophobic silica added to the outer periphery thereof in an amount of 0.3 wt % to 2.0 wt %.

12. An apparatus as claimed in claim 1, wherein said developer carrier has a surface portion thereof constituted by a plurality of portions each having a particular dielectric constant.

13. In a multicolor image forming apparatus for forming a visible multicolor image on an image carrier and then transferring said visible multicolor image to a transfer medium at one time;

developing means respectively assigned to a second and successive colors each comprising:

a developer carrier for carrying a one component type developer on a surface thereof; and bias voltage applying means for applying to said developer carrier a periodically changing bias voltage having one period consisting of a first period of time and a second period of time;

said bias voltage applying means applying for said first period of time a first voltage which generates in a gap between said image carrier and said developer carrier an electric field for causing the developer to fly toward an image area and a non-image area of said image carrier;

said bias voltage applying means applying for said second period of time a second voltage which generates in said gap an electric field for causing the developer to fly toward said image area, and returning the developer having flown toward said non-image area during said first period of time toward said developer carrier;

said first period of time being selected such that the developer does not reach said non-image area;

for development in the second and successive colors, adhesion of the developer existing on said image carrier to said image carrier being not susceptible to the electric field generated in said gap by said bias voltage.

14. An apparatus as claimed in claim 13, wherein an amount of charge deposited on the developer existing on said image carrier is greater than 20 μc/g.

15. An apparatus as claimed in claim 13, wherein the developer existing on said image carrier has a particle size smaller than 10 μm.

16. An apparatus as claimed in claim 13, wherein the developer has a degree of cohesion of 15% to 50% before development.

17. An apparatus as claimed in claim 13, wherein the developing means for the first color comprises developing means using a two component type developer.

18. An apparatus as claimed in claim 13, wherein said first voltage and said second voltage comprise a pulse voltage and a DC voltage, respectively, a potential difference between said pulse voltage and said DC voltage being 300 V to 600 V in absolute value.

19. An apparatus as claimed in claim 13, wherein van der Waals' forces acting on the developer existing on said image carrier are greater than an electrostatic force exerted by the electric field developed in said gap by said bias voltage on said developer.

* * * * *